US005795095A

United States Patent [19]

Heller

[11] Patent Number: 5,795,095

[45] Date of Patent: Aug. 18, 1998

[54] SIMULTANEOUS LEFT TURN VEHICULAR INTERSECTION

[76] Inventor: Kenneth G. Heller, P.O. Box 1219, Meadow Vista, Calif. 95722

[21] Appl. No.: 960,743

[22] Filed: Oct. 29, 1997

[51] Int. Cl.[6] ..... E01C 1/00

[52] U.S. Cl. ..... 404/1

[58] Field of Search ..... 404/1

[56] References Cited

U.S. PATENT DOCUMENTS

| | | | |
|---|---|---|---|
| 1,173,505 | 2/1916 | Hale . | |
| 1,515,251 | 11/1924 | Graves | 404/1 |
| 1,543,080 | 6/1925 | Graves | 404/1 |
| 3,107,590 | 10/1963 | Cedeno . | |
| 3,272,097 | 9/1966 | Gazis et al. | 404/1 |
| 3,394,638 | 7/1968 | Burrell | 94/1 |
| 3,915,580 | 10/1975 | Kaufman | 404/1 |
| 4,592,673 | 6/1986 | Lee | 404/1 |
| 4,630,961 | 12/1986 | Hellwig | 404/1 |
| 5,049,000 | 9/1991 | Mier | 404/1 |

*Primary Examiner*—Tamara L. Graysay
*Assistant Examiner*—Gary S. Hartmann

[57] ABSTRACT

A right hand traffic intersection at grade of four roadways and method of directing vehicles to cross an intersection center bidirectionally along two opposed roadways in Phase 1, along the other two roadways in Phase 2, and to make simultaneous protected left- or U-turns from all four roadways, with through-traffic stopped, in Phase 3 of a 3-phase signal cycle. Two left turn passages in each roadway located between incoming and outgoing main lanes terminate at the intersection center at two locations, cross at an interchange zone some distance from the center and connect to the main lanes yet farther from the center. Vehicles making a left turn enter the center from the left passage whereas traffic arriving from a left turn enter the right passage. This keeps all left turn tracks in the center apart. Traffic signals control traffic at the intersection center and interchange zones. The design and methodology for a three-roadway, "T"-shaped, intersection is similar. The stem of the "T" has two left turn passages and an interchange zone, the right top has a single left turn lane and the left top has none. Signals follow a 2-phase cycle, during Phase 1 vehicles may cross the intersection center bidirectionally in the top of the "T", and in Phase 2 vehicles may make simultaneous protected left- or U-turns from the stem and from the right top with through-traffic stopped.

20 Claims, 10 Drawing Sheets

SIMULTANEOUS LEFT TURN VEHICULAR INTERSECTION

BACKGROUND

1. Field of Invention

This invention relates to vehicular roadway intersections with three or four branches at grade and that have controller-actuated traffic signals that split the signal cycle into phases for vehicular flow in the various lanes.

2. Description of Prior Art

Current practice for traffic signal phasing in at grade intersections is to provide four phases. One implementation provides that in Phase 1 traffic signals are green followed by yellow on east-west (E-W) and west-east (W-E) lanes with red on north-south (N-S) and south-north (S-N) lanes. In Phase 2 traffic signals are green followed by yellow on N-S and S-N lanes with green on E-W and W-E lanes. Left turn traffic signals are red in all directions during Phases 1 and 2. In Phase 3 signals are green followed by yellow on E-W and W-E left turn lanes with red on all other lanes. Finally in Phase 4 ) signals are green, followed by yellow on N-S and S-N left turn lanes with red on all other lanes. Another currently used implementation provides that in Phase 1 traffic signals are green followed by yellow in E-W lane and E-W left turn lane with signals for all other lanes red. In Phase 2 signals in S-N lane and S-N left turn lane are green followed by yellow with all others red. In Phase 3 signals in W-E lane and W-E left turn lane are green followed by yellow with all others red. Finally in Phase 4 signals in N-S lane and N-S left turn lane are green followed by yellow with all others red. In all of the discussion above and in what follows E-W, W-E, S-N, and N-S are cited for convenience of visualization and are not to be construed as limiting this invention to roadways that parallel the points of the compass. Both of the above implementations, and their derivatives (such as green being aborted when a gap in traffic flow is detected, or relative length of the phases being changed in response to relative traffic density in the roads), are schemes requiring four phases to protect vehicles going through or making left turns in the intersection. As all drivers are painfully aware the waits associated with such schemes and derivatives are long and the associated fuel wastage and added pollution significant. The prior art and patent history is replete with examples of attempts to speed up passage through intersections of roadways by eliminating signals altogether typically by elevating, i.e. grade-separating, one or more crossing lanes with respect to another or others. This is impractical except on major highways and even there formidably expensive. At intersections of city streets there normally is neither the space, nor the finding available to install the massive structures required for grade separations. U.S. Pat. No. 4,630,961 to Hellwig (1986) and U.S. Pat. No. 3,394,638 to Burrell (1968) in which numerous grade separations and no signals are used are examples of this approach.

OBJECTS AND ADVANTAGES

The object of my invention is to speed up passage through and to reduce fuel useage in motor vehicular road intersection by reducing the number of stops and starts and wait times experienced by drivers passing through such intersections or grids of intersections. It is a further object to do so without making recourse to elevated roadways, bridges and the like as is presently the custom or as is contemplated in the aforementioned patent literature. Yet another object of my invention is to achieve the above goals wherever possible by retrofitting existing city intersections without major capital outlays. Still further objects and advantages will become apparent from a consideration of the ensuing description and drawings.

DRAWING FIGURES

Figure 6:
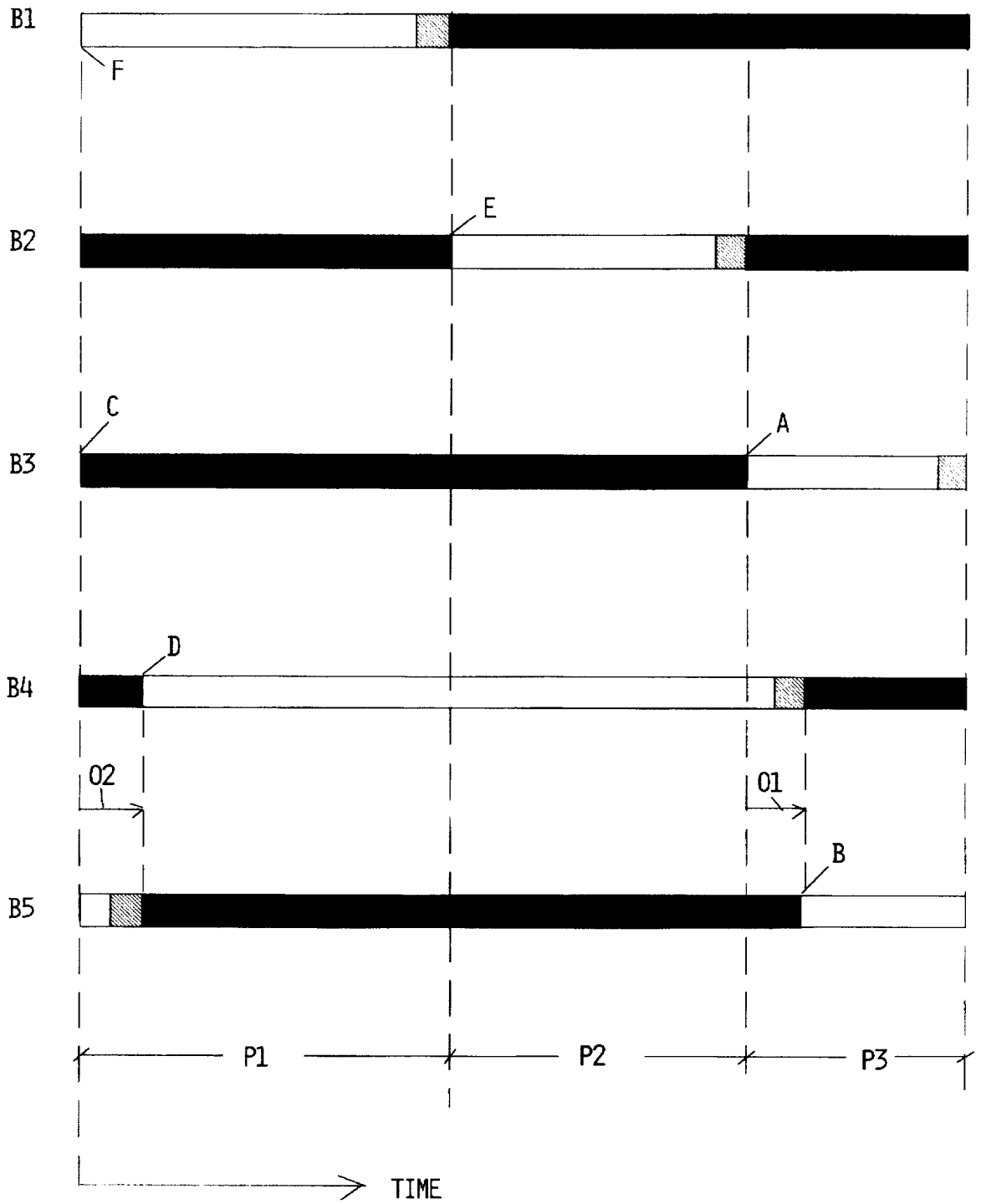

FIG. 6 gives bar graphs of signal phases vs. time in a four-way right hand traffic intersection of all signal lights for one signal cycle.

Figure 7:
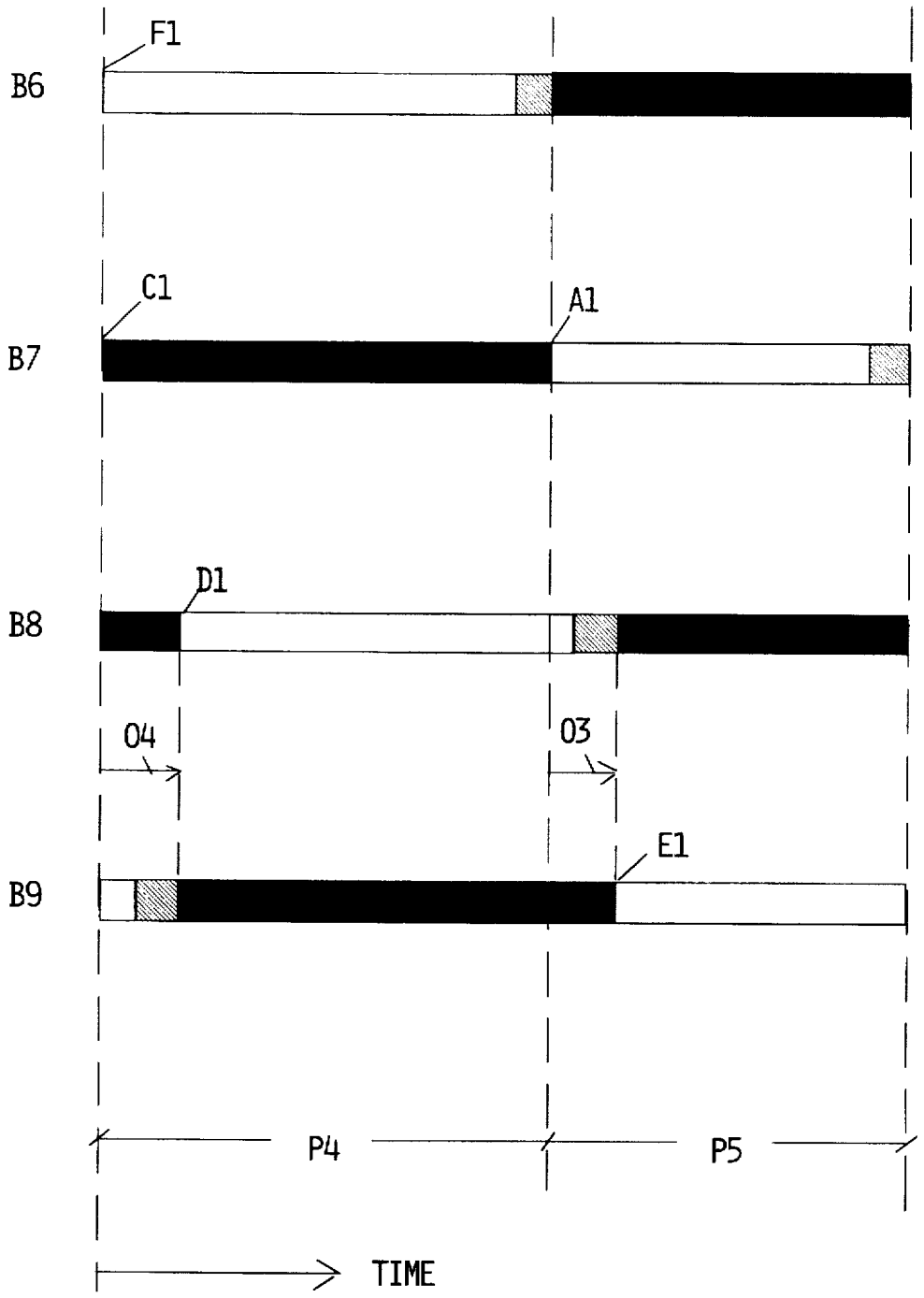

FIG. 7 presents bar graphs of signal phases vs. time in a three-way right hand traffic intersection of all signal lights for one signal cycle.

DESCRIPTION—ROADWAY LAYOUT

Figure 1:
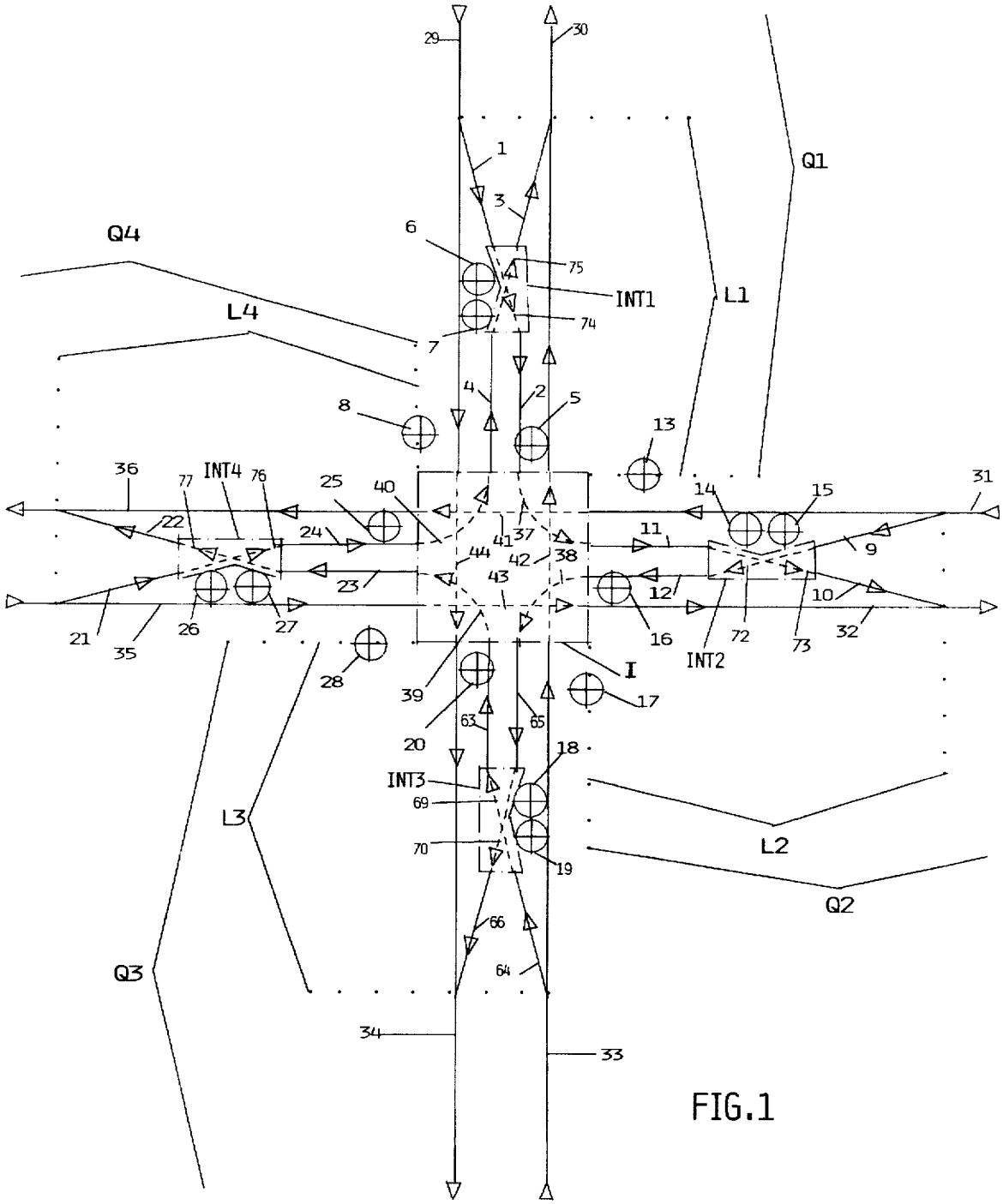
FIG. 1 shows an intersection of four roadways with lane direction (arrowheads) and signal locations for right hand traffic, with signals turned off and no vehicles present.
Figure 4A:
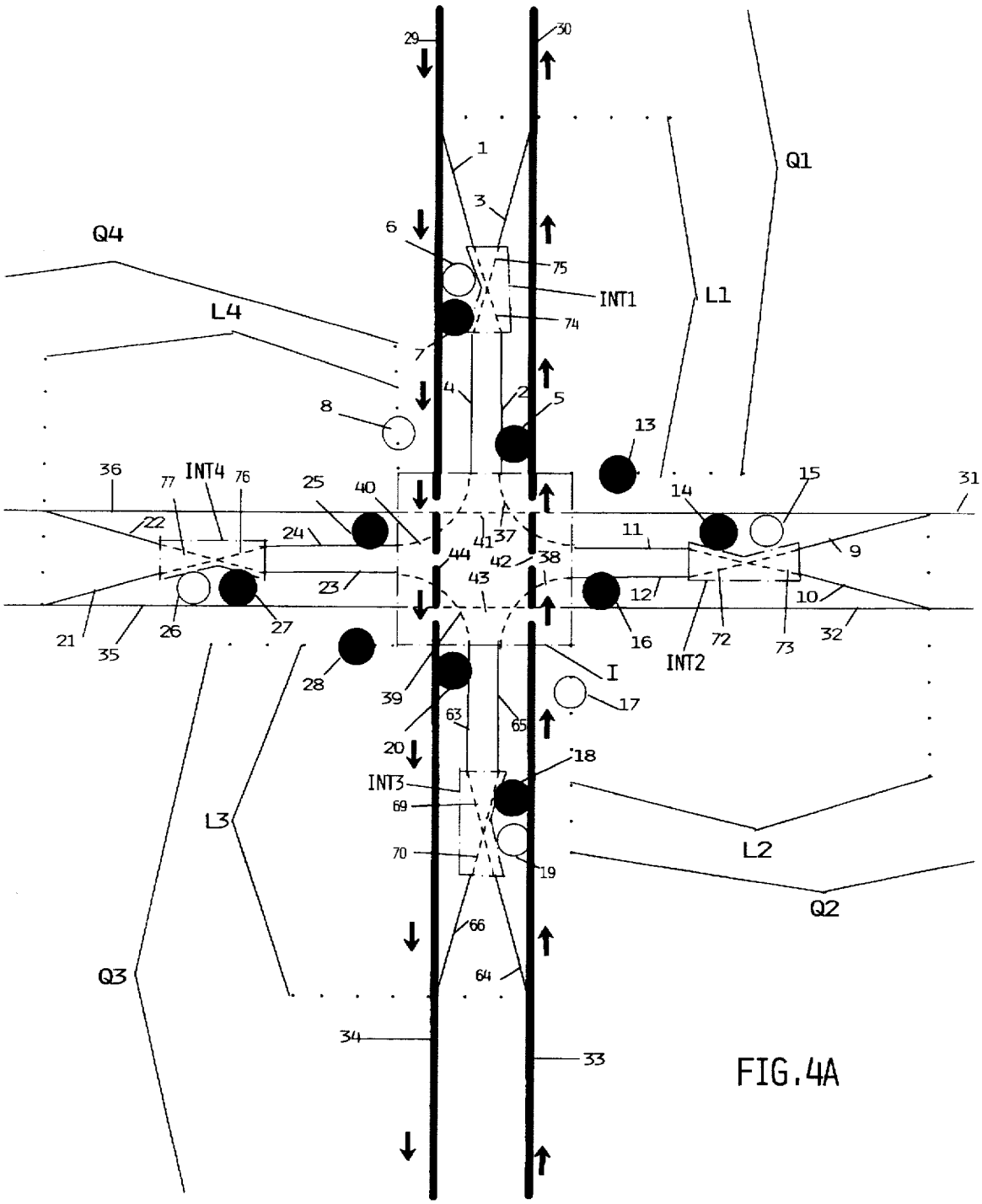
FIGS. 4A–4C show the intersection of four roadways of FIG. 1 with signal light colors and corresponding traffic flow (arrows) for Phases 1, 2, and 3 respectively.
Figure 4B:
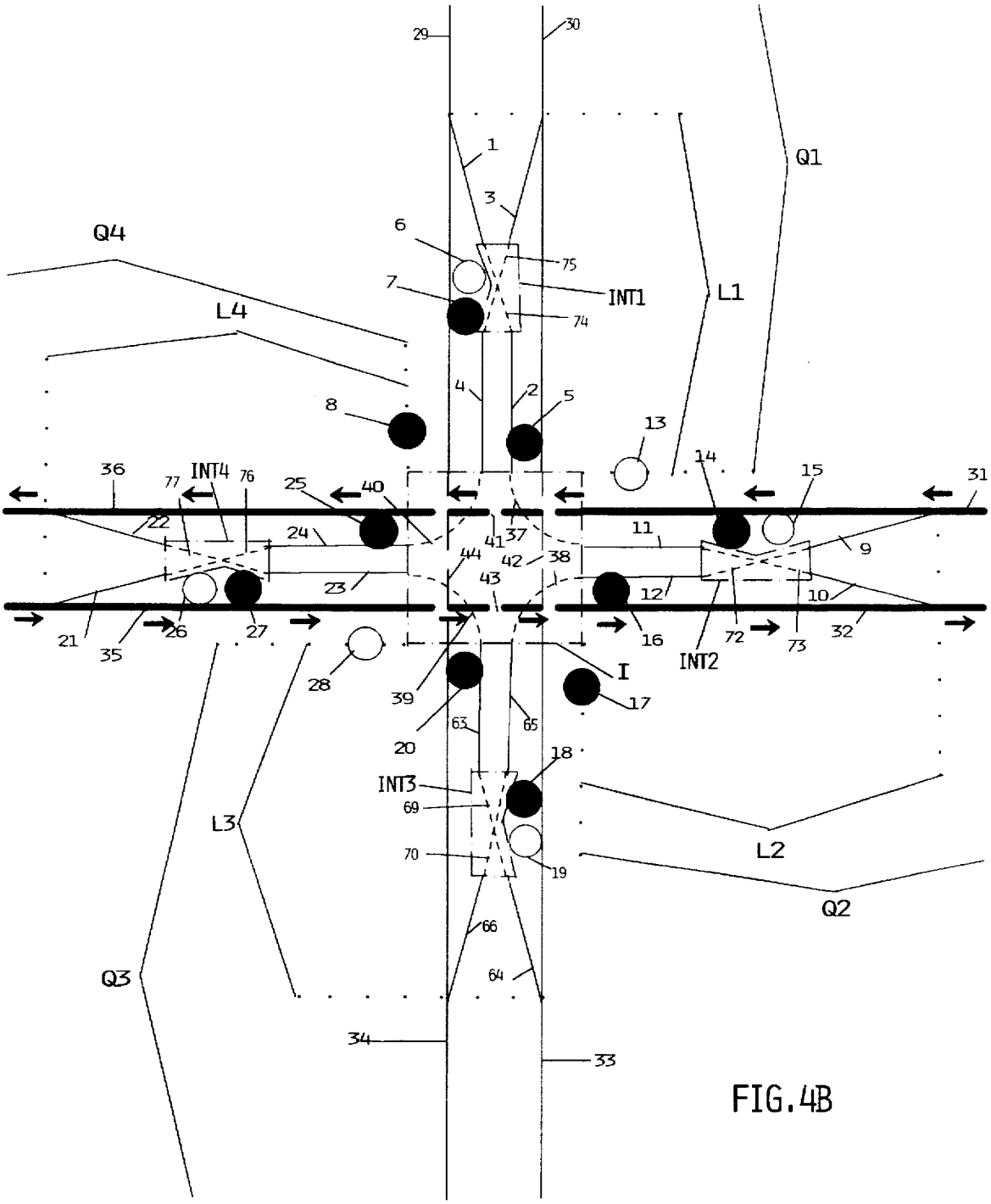
Figure 4C:
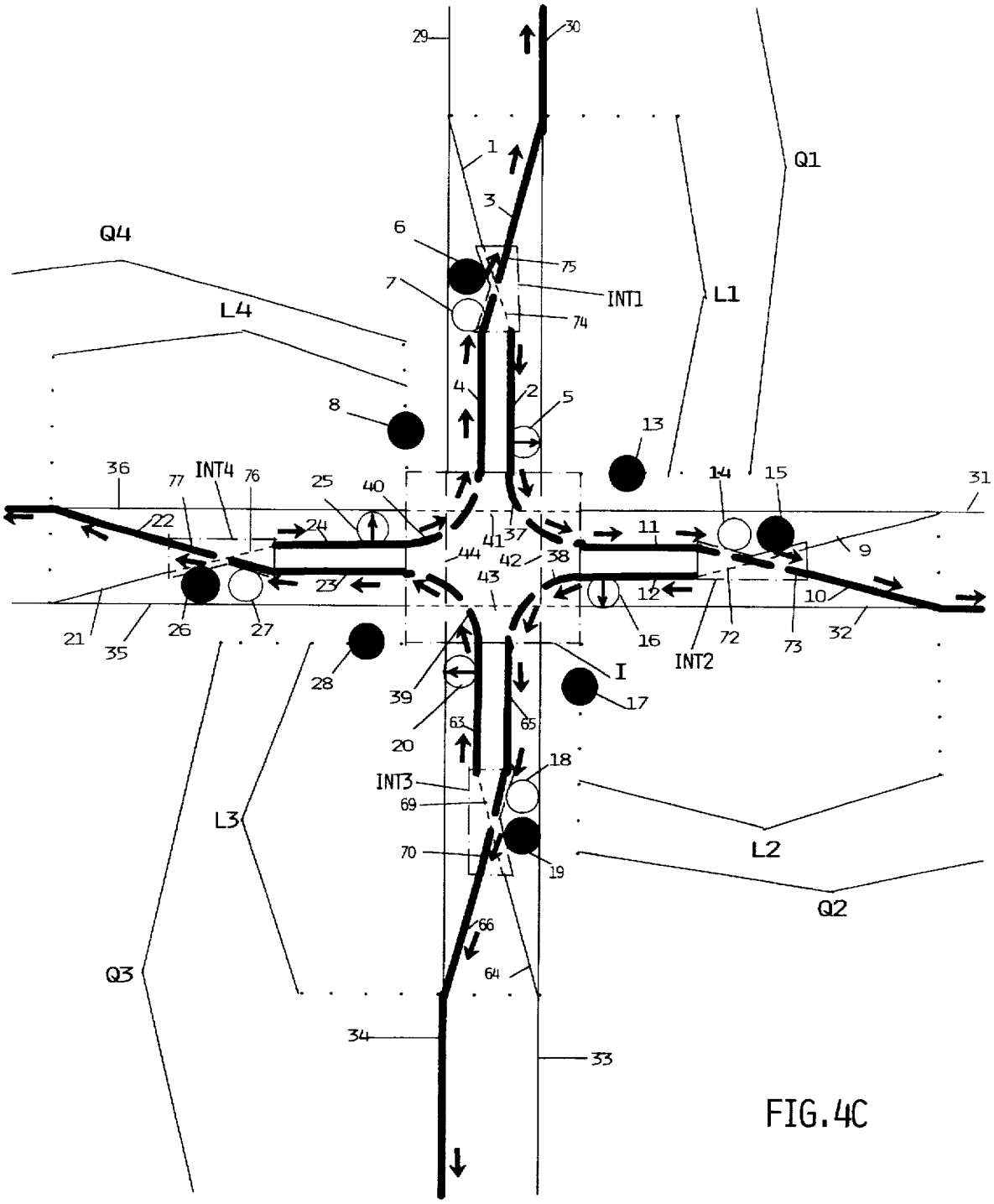

The preferred embodiment of the lane and signal arrangement of my invention for a four-way intersection is shown in FIG. 1 for right hand traffic and will be described as exemplifying the concepts involved. There are four quadrants of lanes meeting at the intersection center I, here for convenience called northern quadrant Q1, eastern quadrant Q2, southern quadrant Q3 and western quadrant Q4 to reflect their orientation relative to the intersection center I. As stated above there is no requirement that these quadrants align with the points of the compass. All lanes and tracks in all quadrants are at grade(i.e. not elevated or depressed with respect to any other lane or track where they meet). All quadrants are shown foreshortened. In a grid of roadways and intersections each roadway extends up to where it meets the corresponding roadway of the adjacent intersection. This location is arbitrary but for convenience may be considered to be the half-way point between the intersections. In the northern quadrant Q1 there are the N-S main lane 29, S-N main lane 30, and the signal 8. Additionally there are the lanes 1, 2, 3, 4, the interchange zone INT1 having tracks 74,75, and traffic control signals 5, 6, 7 forming the left turn complex LI. In the eastern quadrant Q2 there are the E-W main lane 31, W-E main lane 32, and the signal 13. Additionally there are the lanes 9, 10, 11, 12, the interchange zone INT2 having tracks 72,73, and traffic control signals 14, 15, 16 forming the left turn complex L2. In the southern quadrant Q3 there are the S-N main lane 33, the N-S main lane 34, and the signal 17. Further there are the lanes 63, 64, 65, 66, the interchange zone INT3 having tracks 69,70, and traffic control signals 18, 19, and 20 forming the left turn complex L3. In the western quadrant Q4 there are the W-E main lane 35, the E-W main lane 36, and the signal 28. Additionally there are the lanes 21, 22, 23, 24, the interchange zone INT4 having tracks 76,77, and traffic control signals 25, 26, 27 forming the left turn complex L4. Lanes 1, 9, 64 and 21 are referred to as "turnout lanes" in this document. Lanes 2, 12, 63 and 24 are "left turn lanes". Lanes 4, 11, 65, and 23 are "receiving lanes" and lanes 3, 10, 66, and 22 are "merging lanes". Direction of travel in the left turn complexes is toward the intersection center in turnout and left turn lanes, and away from it in the receiving and merging lanes. No U-turn is allowed from the turnout lane into the merging lane, or from the receiving lane into the left turn lane in any quadrant. Through the intersection center vehicles follow the tracks, typically marked by painted striping or reflective bumps on the pavement, shown here as 41 for the E-W main lane and 38 for the E-W left turn lane respectively. The corresponding tracks in the S-N direction are 42 and 39, in the W-E direction 43 and 40, and in the N-S direction 44 and 37. FIG. 1 shows the intersection in an inactive state, i.e. with signal lights turned off (depicted as circles with crosses) and with vehicles deliberately kept away. Reference is made to FIGS. 4A, 4B and 4C for signal light colors and traffic flow during the three phases of the active state.

Figure 2:
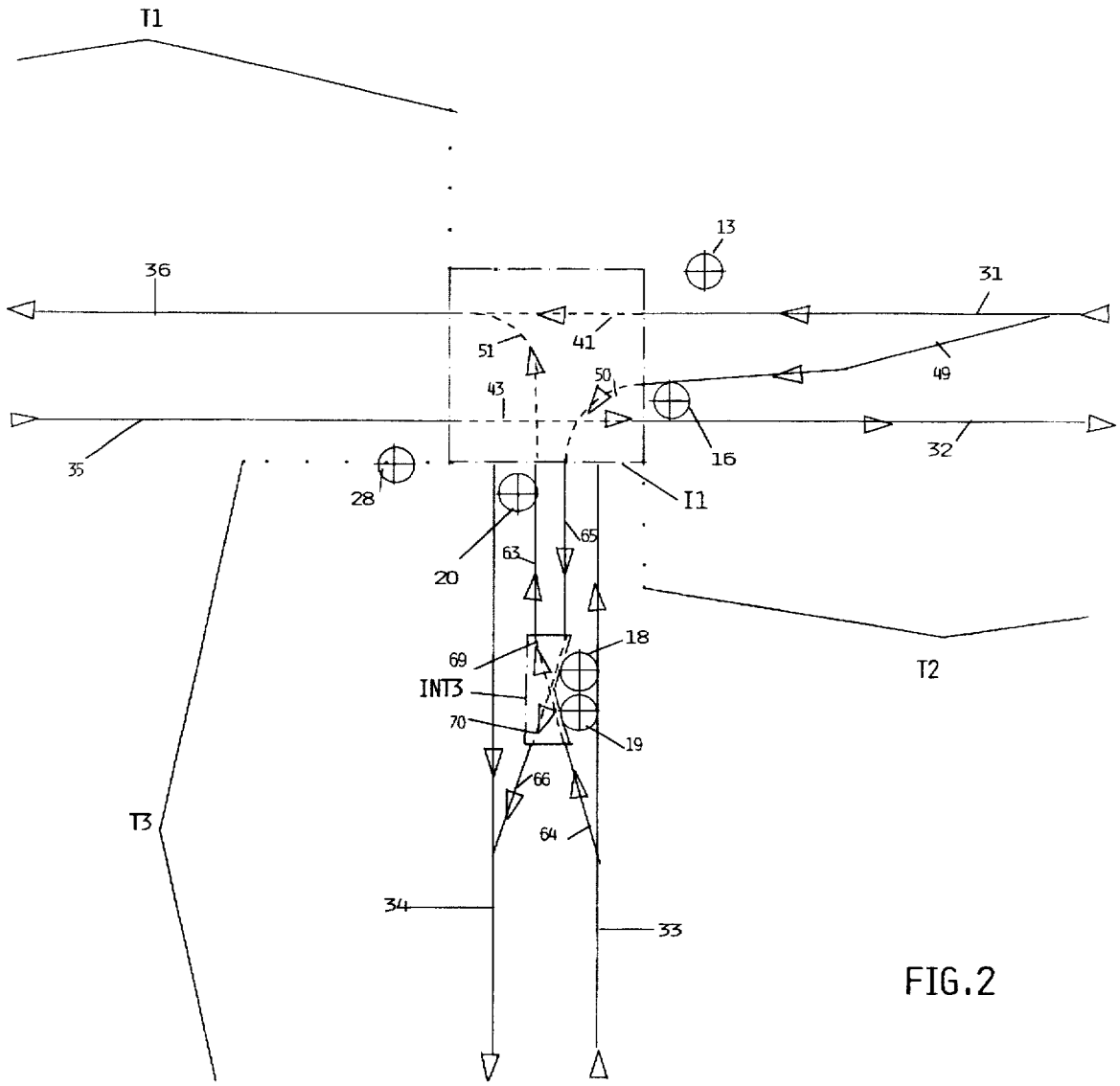
FIG. 2 shows an intersection of three roadways with lane direction (arrowheads) and signal locations for right hand traffic, with signals turned off and no vehicles present.

FIG. 2 shows the preferred embodiment of the invention suitable for three-way intersections in the form of a "T" for right hand traffic. The southern third T3, i.e. the stem of the "T", is the same as Q3 of FIG. 1 except that it does not have a S-N traffic signal 17. Eastern third T2, i.e. the right half of the top of the "T", consists of the E-W lane 31, the W-E lane 32, the signal lights 13 and 16 and the left turn lane 49. The western third T1, i.e. the left half of the top, consists of the W-E lane 35, the E-W lane 36, and has the signal light 28. T1, T2 and T3 meet at the intersection center I1. FIG. 2 shows the intersection in an inactive state. Reference is made to FIGS. SA and 5B for signal light colors and traffic flow during the two phases of the active state.

Figure 3:
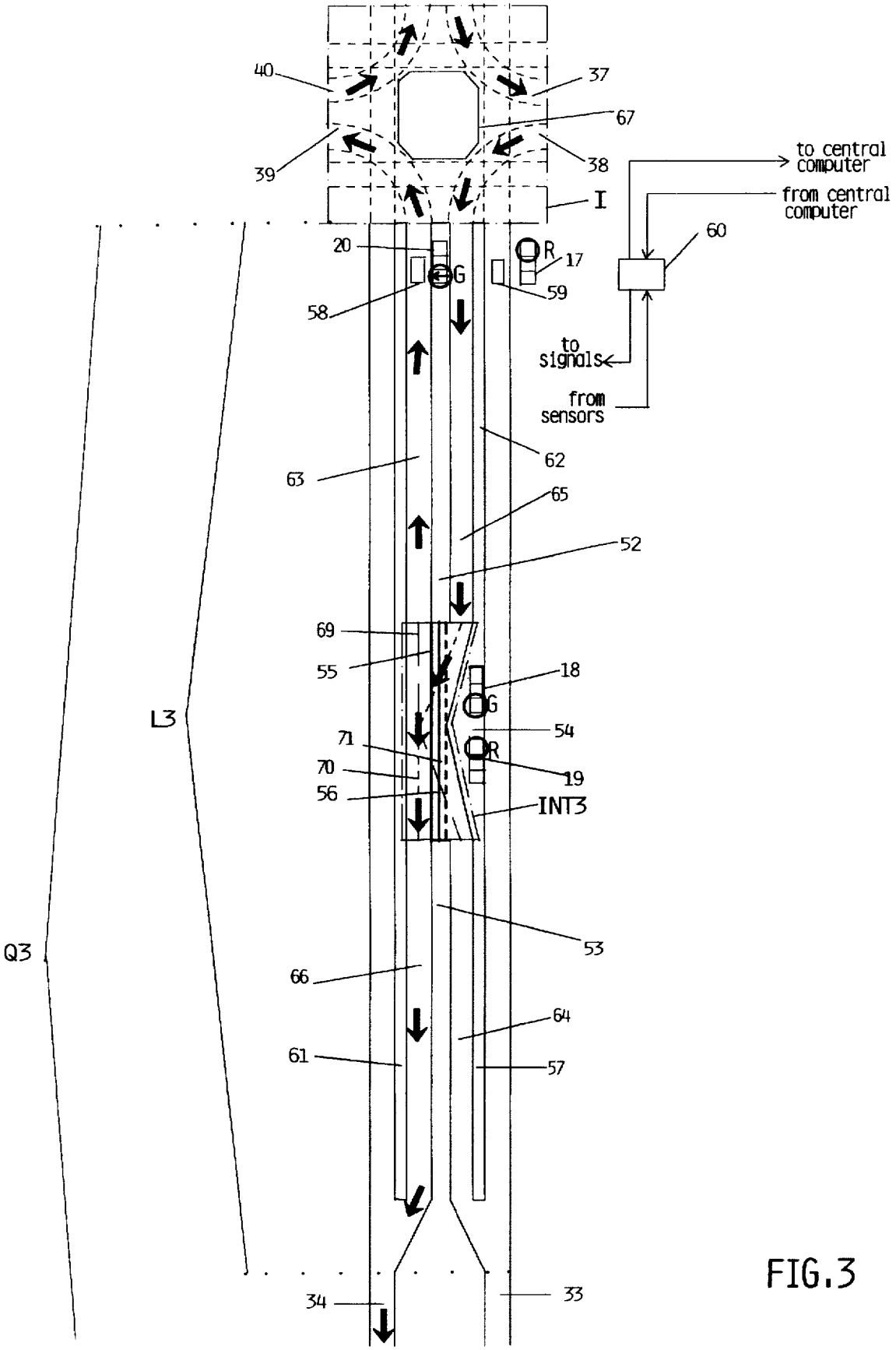
FIG. 3 depicts physical details of lane layout and traffic sensing and traffic signal controller means for one of the quadrants of FIG. 1, with traffic flowing under Phase 3 traffic conditions (see below for a description of signal phases).

FIG. 3 shows details of the preferred constructional embodiment of quadrant Q3 of FIG. 1 under Phase 3 conditions (see next section for description of phases). The interchange zone INT3 contains a breach 71 between the dividers 52 and 53, a barrier 54 approximately dividing the breach into two parts of equal lengths, roadway striping 55 between the barrier 54 and divider 52, and striping 56 between barrier 54 and divider 53, a track 69 between lanes 64 and 63, and a track 70 between lanes 65 and 66. Both stripings are implemented as double solid lines with a single dashed line on the right side as viewed by a driver heading toward the intersection center which advises him that he may cross from the dashed line side but is prohibited to return. In Phase 3 signal light 18, depicted in this figure as a three-lamp fixture, and facing 65, has the green light on (as shown by a circle), and the red and yellow lights off (as shown by a blank), and light 19 facing lane 64 has the red light on so that vehicles coming from a left turn from the eastern quadrant (not shown) along track 38 can pass from lane 65 into lane 66 without interference from vehicles in lane 64. Other cautionary signs such as "do not enter—wrong way" may be added at strategic locations to protect against drivers accidentally drifting into oncoming traffic. Also in Phase 3 vehicles that had previously queued in lanes 63 make a left turn through the intersection center along track 39. Western and northern quadrants are also not shown, but left turning vehicles from those quadrants are depicted as traversing the intersection center by arrows along tracks 40 and 37 respectively. An optional barrier 67 centrally located in the intersection center can be added to supplement the left turn tracks 37, 38, 39, and 40 to further protect against vehicles that are making simultaneous left turns from the four quadrants drifting into each other's space. Dividers 61, 62 and 57 are provided to separate streams of traffic for safety. Vehicle parameter sensor means 58 and 59 selected from a group consisting of wire loops, optical scanners, contact sensors, pressure sensors, heat sensors and exhaust sensors, are located in or adjacent to the main lane and left turn lane respectively, in locations chosen for optimum traffic control (as discussed below), and are connected by wire or wireless means to a traffic controller 60. The controller in turn is connected to the signal lights by wire or by wireless means and sends instructions to them. Sensors and connections to the controller are shown for Q3 only, but it must be understood that they are typically installed in all quadrants. The controller may itself be connected by wire or wireless means to a central computer for grid-wide control of motor traffic. This constructional embodiment is compact enough for disposition within the confines of many existing city intersections, particularly if they already have two adjacent left turn lanes in one or more quadrants.

DESCRIPTION—TRAFFIC CONTROL

Referring now to FIG. 4A showing Phase 1 for a four-way intersection, signal 8, facing traffic proceeding along lane 29, and signal 17, facing 33, are green, followed by yellow, and vehicles stream through the intersection center I in the N-S and S-N directions. Others make left turnouts randomly into lanes 1 and 64. (For compactness in this and following figures all three-lamp signal lights are shown as single circles. Green signal lights are shown as circles with empty interiors, red signals have black interiors). Signal 6, facing 1 and signal 19 facing 64 are also green, followed by yellow, allowing left turning vehicles to progress through the interchange zones INT1 and INT3 via tracks 74 and 69 into lanes 2 and 63 to the intersection center where they queue at the red signal lights 5 and 20. Any vehicles still in the lanes 4 and 65 are restrained by red signals 7 and 18 from crossing in front of vehicles making turnouts and queuing. Furthermore, vehicles are prohibited from blocking interchange zones (defmed as entering a zone without having room ahead to clear it) to help avoid congestion. In the E-W and W-E directions vehicles are stopped in lanes 31 and 35 by red signals 13 and 28 from crossing the intersection center thus forcing them to queue. Other vehicles turn randomly into lanes 9 and 21, and with signals 15, facing 9, and 26, facing 21, both green, followed by yellow, progress through interchange zones INT2 and INT4 via tracks 72 and 76 into lanes 12 and 24 to the intersection center I where they queue at the red left turn signal lights 16 and 25. Any vehicles still in lanes 23 and 11 are restrained by red signals 27 and 14 from crossing in front of vehicles progressing through the zones.

In Phase 2 (FIG. 4B) signals 8 and 17 are red, with 13 and 28 green, followed by yellow, and all other signals are the same as in Phase 1. Vehicles stream through the intersection center in E-W and W-E directions, and are stopped and queue in the S-N and N-S directions.

In Phase 3 (FIG. 4C) signals 8, 13, 17, and 28 are red stopping all through traffic at the intersection center I. All four left turn signal lights 5, 16, 20, 25 are green, followed by yellow, as are all four interchange zone signals 7, 14, 18, and 27. Thus all vehicles in the four quadrants which had queued for left turns during Phases 1 and 2 are now able to make simultaneous left turns from the left turn lanes through the intersection center I into the receiving lanes in the quadrants to their left, flow through the interchange zones in said quadrants, and finally merge into departing main lanes of said quadrants. Interchange zone signals 6, 15, 19, and 26 are red to prevent cars in lanes 1, 9, 64 and 21 from colliding with the vehicles making left turns through the intersection center. If the intersection center is wide enough U-turns may be permitted within the confines of the center from some or all left turn lanes into their respective outgoing main lanes interspersed with the left turns. U-turns may possibly have to be limited to smaller vehicles such as cars, pickups, and motorcycles. (U-turn tracks are not shown in the drawing as they are not customarily employed).

Vehicles may be permitted to make right turns within the confines of the center between the incoming main lane of any or all quadrants into the corresponding outgoing main lane of the adjacent quadrant on the right at various times during the phases when that does not conflict with the through traffic and left and U-turn traffic activities (right turn tracks and signalization are not shown).

Figure 5A:
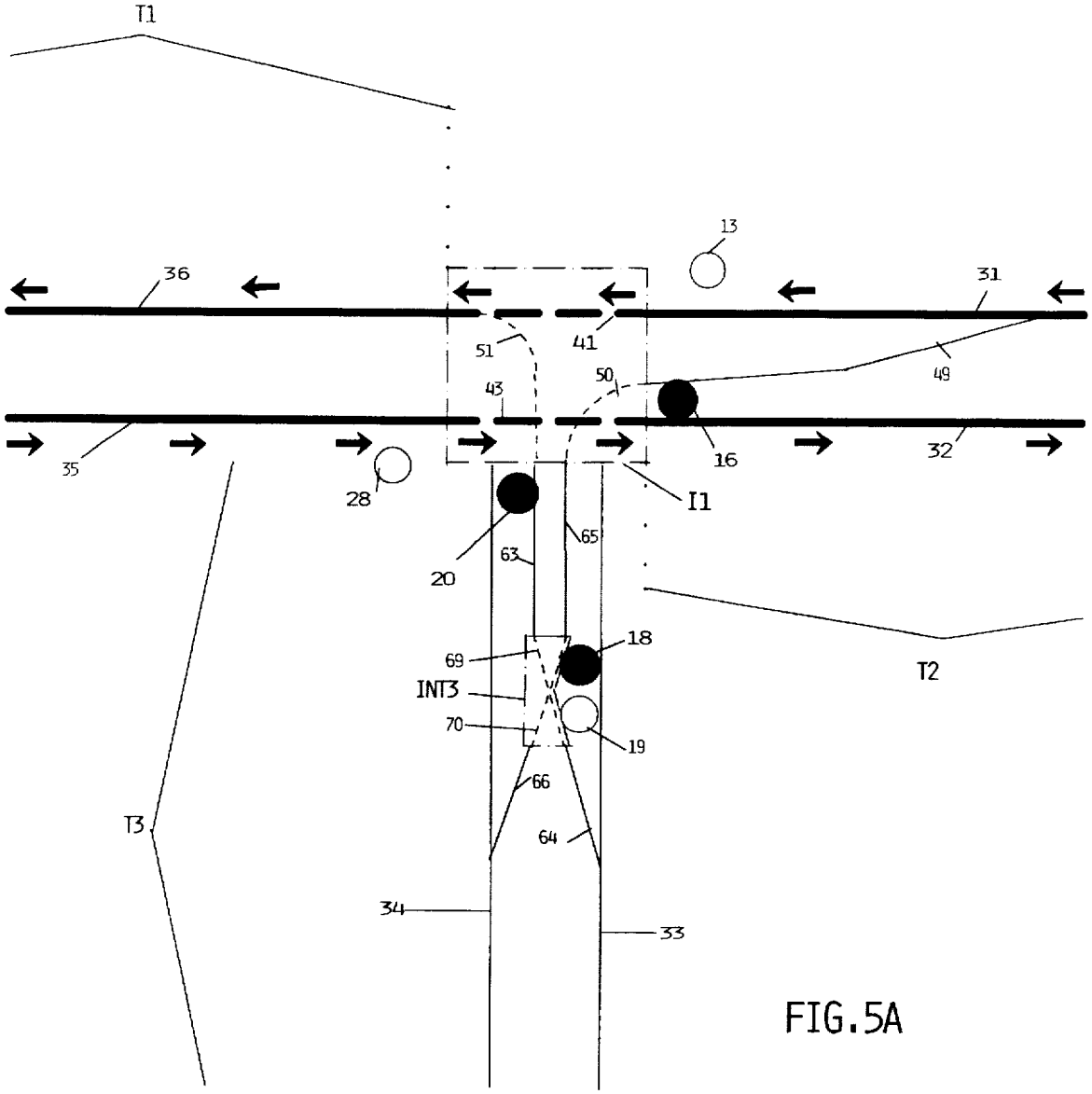
FIGS. 5A–5B show the intersection of three roadways of FIG. 2, with signal light colors and corresponding traffic flow (arrows) for Phases 1 and 2 respectively.
Figure 5B:
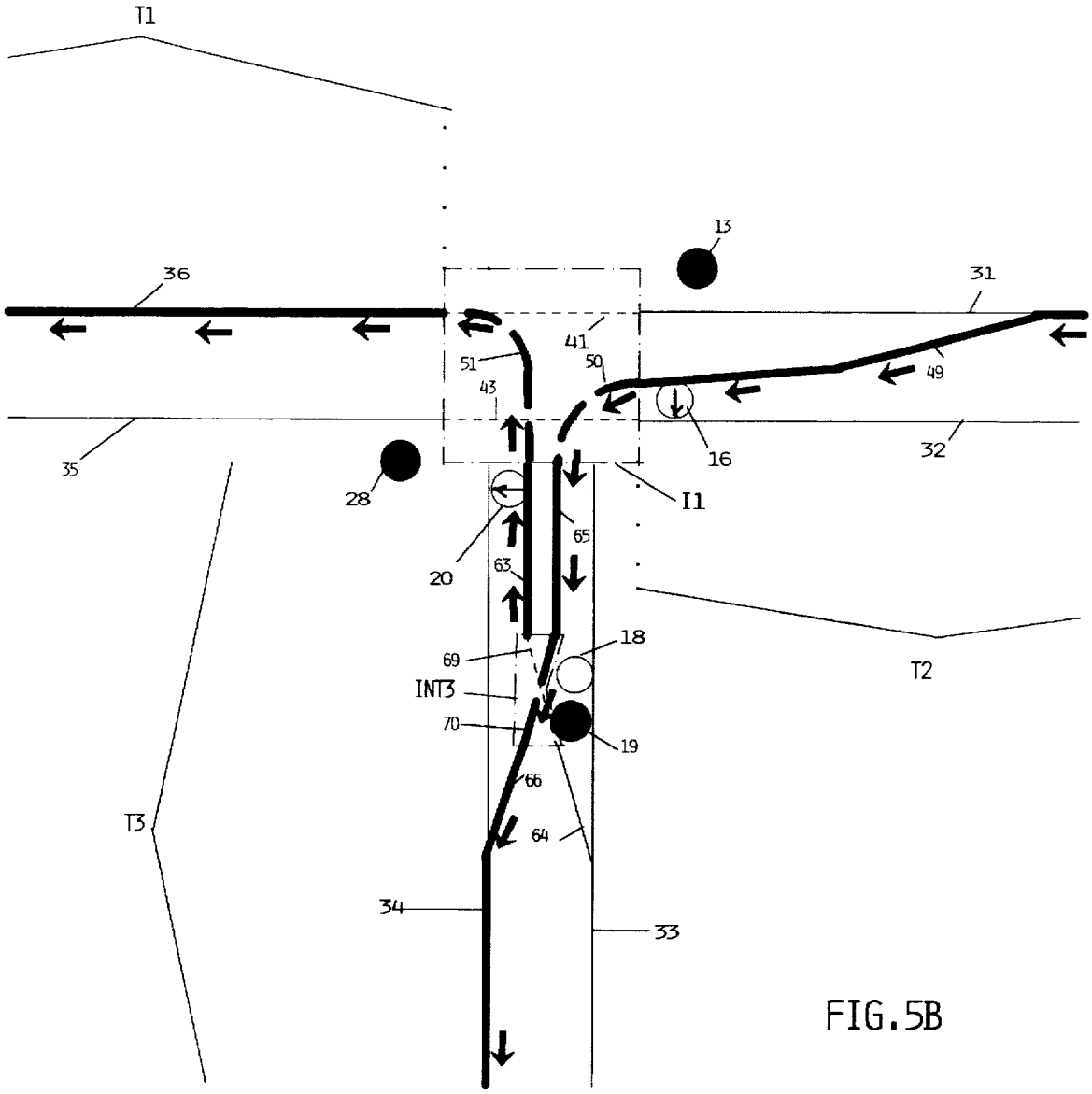

In a three-way intersection per FIG. 5A vehicles stream across the intersection center I1 in Phase 1 between the western third T1 and the eastern third T2. They randomly turn off from the E-W lane 31 into turn lane 49 preparatory to making a left turn through the intersection center I1 and queue at the red left turn signal light 16. In the southern third T3 cars randomly turn into lane 64 from S-N lane 33 and pass into lane 63 through the green, followed by yellow, interchange signal light 19 facing lane 64 and queue at the red left turn signal light 20 at the intersection center. Interchange zone INT3 signal light 18, facing 65, is red to prevent straggling vehicles in that lane from colliding with traffic flowing along lane 64. In Phase 2, as shown in FIG. 5B queued vehicles and others that randomly turn left from E-W lane 31 make a left turn from 49 past the green, followed by yellow, left turn signal light 16 through the intersection center along track 50 into lane 65. From there they go through the green, followed by yellow, signal light 18 of the southern interchange zone INT3 into lane 66 to merge into the N-S main lane 34. Vehicles previously queued in lane 63 simultaneously make a left turn across the intersection center along track 51 to merge directly into the E-W lane 36. If the intersection center is wide enough U-turns may be permitted within the confines of the center from one or both left turn lanes into their respective outgoing main lanes interspersed with the left turns. As in the case of the fourway intersection U-turns may have to be restricted to smaller vehicles.

Vehicles may be permitted to make right turns within the confines of the center between the incoming main lane of a quadrant into the corresponding outgoing main lane of the adjacent quadrant on the right, if one exists, at various times during the phases when that does not conflict with the through traffic and left and U-turn traffic activities (right turn tracks and signalization are not shown).

In FIGS. 1, 2, 4A–4C, and 5A–5B lanes in which traffic is directly engaged in flowing through the intersection center(except right turning traffic) are shown in bold with flow direction depicted by arrows. All other lanes are shown as thin lines even though straggling or queuing vehicles may be present. Tracks through the intersection center are shown dashed, again bold or thin. In these figures, and in FIG. 3 the boundaries of the intersection center and of the interchange zones are depicted as dot-dashed lines.

FIG. 6 shows the three phases for a four-way intersection versus time for one signal cycle, which then repeats. Bar Bi represents the N-S and S-N signals, black rectangle with empty interior representing a green light, with hatched interior representing yellow, and all black representing a red light. Bar B2 are the E-W and W-E signals, bar B3 are the left turn signals, bar B4 are the interchange signals facing the turnout lanes, bar B5 are the interchange signals facing the receiving lanes. The instant when interchange signals change (point B) is offset in time by an amount O1 with respect to the left turn signals changing to green (point A) and by an amount O2 (point D) with respect to the left turn signals returning to red (point C). The offsets O1 and O2 are adjustable from negative to positive values and may be different from each other. The durations of Phases 1, 2, and 3 shown as P1, P2 and P3 respectively are either empirically set, or automatically adjusted using traffic parameter data, such as vehicular density, and/or gaps in the traffic stream, obtained by sensors in the lanes and sent to the controller, and possibly a central computer, and computer software and hardware installed in them. This traffic detection and signal light adjustment has the intent of optimizing a performance criterion established by the operator of the transportation system. This performance criterion is typically based on transit time of the average vehicle traversing the intersection or a grid of intersections but can also be expanded to contain a component representing fuel used by the average vehicle. A red signal overlap, i.e. a green delay (not shown) ranging from zero to a positive value at points A, B, D, E, and F may be provided to reduce the risk of collisions with vehicles entering late in the yellow part of the signals or illegally running the early part of the red signal in the crossdirection.

FIG. 7 shows the two phases for a three-way intersection versus time for one signal cycle that then repeats. Bar B6 represents the E-W and W-E signals, bar B7 the left turn signal, bar B8 the interchange signal facing the turnout lane, and bar B9 the interchange signal facing the receiving lane. The instant when the interchange signals change (point E1) is offset in time by an amount O3 with respect to the left turn signals changing to green (point A1) and by O4 (point D1) with respect to left turn signals returning to red (point C1). Here, as in the four-way intersection, the offsets can be adjusted from negative to positive values, by equal or unequal amounts, for the same reasons and goals as in the four-way case. Also, for the same reasons and in the same manner as in the four-way case, red overlaps may be provided at points A1, D1, E1 and F1.

Whereas the above descriptions depict preferred embodiments for four- and threeway right hand drive intersections, these are not the only ones foreseen and should therefore not be construed as limiting the scope of this invention. Other embodiments will be evident to individuals skilled in the field of this invention, and include, but are not limited to, a plurality of main lanes in each direction rather than the one lane shown, a plurality of left turn passages in each direction rather than the one shown in each roadway, and making provision for pedestrian crossing.

I claim:

1. An intersection for right-hand vehicular traffic accommodating four intersecting roadways at grade, having an intersection center, and in each roadway comprising:

a) Incoming and outgoing main lanes for flow of incoming and outgoing traffic relative to said center, said lanes meeting said center at two locations;

b) A left turn lane complex positioned between said main lanes consisting of oppositely directed passages for flow of incoming and outgoing left turn traffic relative to said center, said passages crossing at an interchange zone some distance removed from said center, said zone dividing the incoming passage into a turnout lane and a left turn lane, and dividing the outgoing passage into a receiving lane and a merging lane, said left turn lane and receiving lane joining said center at a first and second left turn junction respectively, said first junction being to the left of said second junction viewed by a driver approaching said center, and the remote ends of said turnout and merging lanes joining said incoming and outgoing main lanes respectively;

c) A track through said center connecting said incoming main lane in one roadway with said outgoing main lane in the roadway opposite;

d) A track through said center connecting said first left turn junction with a corresponding second left turn junction of the roadway to the left;

e) Traffic control means at said interchange zone; and f) Traffic signal means located where said incoming main lane meets said center and at said first left turn junction timed so as to permit traffic to flow along said main lanes in the first pair of opposed roadways in a first phase, along said main lanes in the opposed pair in the cross direction in a second phase, and to make simultaneous protected left turns from, and optionally U-turns in all four roadways, with said main lane flow stopped, in a third phase of a three-phase signal cycle, which then repeats itself.

2. An intersection as in claim 1 wherein said left turn complex in any one roadway occupies two inner neighboring lanes, there is a dividing means between said lanes, a breach in said dividing means and a deflecting barrier in the right inner lane centrally located relative to said breach urging motor vehicles in said turnout lane portion of that lane to veer across one-way transit means arranged substantially along the full length of the breach into the left turn lane portion of said left inner lane where they travel on to said first junction, and urging traffic in said receiving lane portion of said right inner lane coming from said second junction to veer across said one-way transit means into said merging lane portion of said left inner lane.

3. An intersection as in claim 2 wherein said one-way transit means comprises two solid lines on the left side and a dashed line on the right side, as viewed by the incoming driver, painted or otherwise marked on the pavement, advising the driver he may cross from the dashed side but may not cross back.

4. An intersection as in claim 2 wherein said main lane, left turn lane and interchange zone signal means provide predetermined timings.

5. An intersection as in claim 2 wherein said main lane, left turn lane and interchange zone signal means in all roadways provide variable timings which are automatically controlled by controller means.

6. An intersection as in claim 5 wherein said controller means comprises sensor means in or adjacent to the lanes in a plurality of quadrants, a controller, and optionally a central computer for a plurality of intersections in the surrounding road grid, controller and computer connected and equipped with algorithm means which optimizes traffic performance at said intersection or grid of intersections.

7. An intersection as in claim 6 wherein the algorithm takes into account one or more of the following criteria a) fuel spent by the average motor vehicle in traversing one or a grid of intersections, b) the associated exhaust products discharged into the atmosphere, and c) the average time taken by vehicles in traversing said intersection or said grid.

8. An intersection for right-hand vehicular traffic accommodating three intersecting roadways at grade configured approximately in the form of a "T" and having an intersection center and a) Each roadway having incoming and outgoing main lanes for incoming and outgoing traffic relative to said center, said lanes meeting said center at two locations;

b) In the stem of the "T" having a left turn lane complex positioned between said main lanes consisting of oppositely directed passages for incoming and outgoing left turn traffic relative to said center, said passages crossing at an interchange zone some distance removed from said center, said zone dividing said incoming passage into a turnout lane and a left turn lane, and dividing said outgoing passage into a receiving lane and a merging lane, with left turn lane and receiving lane joining said center at a first and second left turn junction respectively, said first junction being to the left of said second junction as viewed by a driver approaching said center, and the remote ends of said turnout and merging lanes joining said incoming and outgoing main lanes respectively;

c) A track through said center connecting said incoming main lane in either of the two opposed roadways forming the top of the "T" with said outgoing main lane of the roadway opposite;

d) A track through said center connecting said first left turn junction of said stem with said outgoing main lane of said left half of said top;

e) A track through said center connecting a left turn lane of said right half of said top to said second left turn junction of said stem;

f) Traffic control means at said interchange zone in said stem; and g) Traffic signal means located where said incoming main lanes meet said center in said two roadways of said top and at the junction of said incoming left turn lanes in said right top and in said stem, timed so as to permit traffic to flow along said main lanes in said pair of opposed roadways in said top in a first phase, and to make simultaneous protected left turns from, and optionally U-turns in said right top and said stem with said main lane flow stopped, in a second phase of a two-phase signal cycle, which then repeats itself.

9. An intersection as in claim 8 wherein said left turn complex in the roadway forming said stem of said "T" occupies two inner neighboring lanes, there is a dividing means between said inner two lanes, a breach in said dividing means and a deflecting barrier in said right inner lane centrally located relative to said breach urging motor vehicles in said turnout lane portion of that lane to veer across said one-way transit means arranged substantially along the length of said breach into said left turn lane portion of said left inner lane where they travel on to said first junction, and urging traffic in said receiving lane portion in said right inner lane coming from said second junction to veer across said one-way transit means into said merging lane portion of said left inner lane.

10. An intersection as in claim 9 wherein said one-way transit means comprises two solid lines on the left side and a dashed line on the right side, as viewed by the incoming driver, painted or otherwise marked on the pavement, advising the driver he may cross from the dashed side but may not cross back.

11. An intersection as in claim 10 wherein said signal means for said main lanes, left turn lanes and interchange zone provides predetermined timing.

12. An intersection as in claim 10 wherein said signal means for said main lanes, said left turn lanes and said interchange zone have variable timings which are automatically controlled by controller means.

13. An intersection as in claim 12 wherein said controller means comprises sensor means in and adjacent to the lanes, a controller, and optionally a central computer for a plurality of intersections in the surrounding road grid, controller and computer interconnected and equipped with algorithm means which optimizes traffic performance at the intersection or grid of intersections.

14. An intersection as in claim 13 wherein the algorithm takes into account one or more of the following criteria a) fuel spent by the average motor vehicle in traversing one or a grid of intersections, b) the associated exhaust products discharged into the atmosphere, and c) the average time taken by vehicles in traversing said intersection or said grid.

15. The method of directing vehicles in right-hand traffic in four roadways at grade that meet at a intersection center to flow through it by employing means to control traffic in three-phased cycles designed to keep vehicles on paths that are separated from each other at all times, comprising the steps of:

a) Enabling vehicles to travel across said center in both directions on incoming and outgoing main lanes between a first pair of opposed roadways and to queue in a second pair in a cross direction and in all four left turn lanes at said center in a first phase of said three-phase traffic signal cycle;

b) Enabling vehicles to travel across said center in both directions between said second pair of opposed roadways and to queue in said first pair and in said four left turn lanes at said center in a second phase; and c) Stopping vehicles in said first and second pairs of opposed roadways and enabling vehicles that previously queued to make simultaneous protected left- and U-turns from said four left turn lanes in the third phase.

16. A method as in claim 15 using lane interchange means at some distance from said center in each roadway to enable left turning vehicles coming from a turnout from said incoming main lane to meet said center boundary at a first location which is to the left of a second location on said boundary where vehicles arrive that have just made a left turn from the roadway on the right, whereby the paths of vehicles making left turns in said four roadways are separated at all times, and enabling said latter vehicles to merge into said outgoing main lane.

17. A method as in claim 16 wherein said three phases are enabled by the action of computer controlled signal lights located where said incoming main lanes and left turn lanes meet said boundary and at said interchange means in each roadway.

18. The method of directing vehicles in right-hand traffic in three roadways at grade in the approximate form of a "T" having a top and a stem, that meet at an intersection center, to flow through it by employing means to control traffic in two-phased cycles designed to keep vehicles on paths that are separated at all times, comprising the steps of:

a) Enabling vehicles to travel across said center in both directions on incoming and outgoing main lanes between the pair of opposed roadways in the top of said "T", and to queue in all left turn lanes at said center in a first phase of a two-phase traffic signal cycle; and b) Stopping vehicles in said top and enabling vehicles that previously queued to make simultaneous protected left- and U-turns from all left turn lanes in the second phase.

19. A method as in claim 18 using lane interchange means some distance from said center in said stem to enable left turning vehicles coming from a turnout from the incoming main lane in the stem to meet the center boundary at a first location which is to the left of a second location on said boundary where vehicles arrive that have just made a left turn from the roadway forming the right side of said top, whereby the left turn paths from said roadways are separated from each other at all times, and enabling said latter vehicles to merge into the outgoing main lane of said stem.

20. A method as in claim 19 wherein said two phases are enabled by the action of computer controlled signal lights located where said incoming main lanes and left turn lanes meet said boundary and at said interchange means.

* * * * *

UNITED STATES PATENT AND TRADEMARK OFFICE

CERTIFICATE OF CORRECTION

PATENT NO. : 5,795,095

DATED : August 18, 1998

INVENTOR(S) : Kenneth G. Heller

It is certified that error appears in the above-identified patent and that said Letters Patent is hereby corrected as shown below:

"Col. 1, line 51 change 'finding' to – funding –."

"Col. 2, line 54 change 'LI' to – L1 –."

"Col. 3, line 32 change 'SA' to – 5A –."

"Col. 4, line 37 change 'defmed' to – defined –."

"Col. 5, line 61 change 'Bi' to – B1 –."

Signed and Sealed this

Twenty-third Day of February, 1999

*Attest:*

Q. TODD DICKINSON

*Attesting Officer*

*Acting Commissioner of Patents and Trademarks*